US005642821A

United States Patent [19]

Häfliger

[11] Patent Number: 5,642,821

[45] Date of Patent: Jul. 1, 1997

[54] MOBILE CRANE WITH IMPROVED BOOM CONSTRUCTION

[76] Inventor: Werner Häfliger, Wissenbach 209, 8932 Mettmenstetten, Switzerland

[21] Appl. No.: 584,146

[22] Filed: Jan. 11, 1996

Related U.S. Application Data

[63] Continuation of Ser. No. 291,574, Aug. 16, 1994, abandoned, which is a continuation of Ser. No. 130,878, Oct. 4, 1993, abandoned.

[30] Foreign Application Priority Data

Oct. 6, 1992 [CH] Switzerland ..... 03112/92

[51] Int. Cl.[6] ..... B66C 23/26

[52] U.S. Cl. ..... 212/177; 212/231

[58] Field of Search ..... 212/176, 177, 212/185, 187, 188, 168, 230, 231, 175

[56] References Cited

U.S. PATENT DOCUMENTS

| | | | |
|---|---|---|---|
| 1,944,972 | 1/1934 | Faure et al. | 212/176 |
| 3,125,227 | 3/1964 | Kauffman et al. | 212/177 |
| 3,149,730 | 9/1964 | Mork | 212/177 |
| 3,198,345 | 8/1965 | Brekelbaum | 212/295 |
| 3,476,260 | 11/1969 | Thompson | 212/168 |
| 3,872,977 | 3/1975 | Noly | 212/297 |
| 3,945,333 | 3/1976 | Fritch et al. | 212/177 |
| 3,968,884 | 7/1976 | Johnson et al. . | |
| 4,241,837 | 12/1980 | Suverkrop | 212/177 |
| 4,491,229 | 1/1985 | Behrendt et al. | 212/177 |

FOREIGN PATENT DOCUMENTS

| | | | |
|---|---|---|---|
| 2513979 | 4/1983 | France . | |
| 1257391 | 12/1967 | Germany . | |
| 1281128 | 10/1968 | Germany . | |
| 1506548 | 7/1969 | Germany . | |
| 1927187 | 12/1970 | Germany . | |
| 2428073 | 12/1975 | Germany . | |
| 2833535 | 2/1980 | Germany . | |
| 8313245 | 8/1987 | Germany . | |
| 182695 | 7/1990 | Japan | 212/168 |
| 296991 | 5/1965 | Netherlands . | |
| 2041326 | 9/1980 | United Kingdom | 212/188 |

*Primary Examiner*—Thomas J. Brahan
*Attorney, Agent, or Firm*—Wenderoth, Lind & Ponack

[57] ABSTRACT

A mobile crane includes an undercarriage or lower crane carrying chassis, an upper load lifting and carrying chassis pivotally mounted on the lower chassis, a cab located on the upper chassis for operating the crane, a base section that can be swivelled about a horizontal axis, and a separate boom attachable to a free or operating end of the base section. The base section has a novel, essentially one-piece construction that is designed in such a manner that with it alone especially crane operations can be performed. Attachment devices for attaching the separate boom are provided on the free end of the base section. The base section extends virtually over the entire length of the lower chassis. Thus, maximum loads and maximum lifts can be obtained with universal and versatile application.

15 Claims, 2 Drawing Sheets

MOBILE CRANE WITH IMPROVED BOOM CONSTRUCTION

This application is a continuation of now abandoned application, Ser. No. 08/291,574, filed Aug. 16, 1994 which is a continuation of now abandoned application Ser. No. 08/130,878, filed Oct. 4, 1993, both now abandoned.

BACKGROUND OF THE INVENTION

The invention relates to a mobile crane including an undercarriage or lower crane carrying chassis, an upper load lifting and carrying chassis pivotally mounted on the lower chassis, a main boom pivoted on the upper chassis, and at least one further boom that can be connected to the main boom.

In the case of such a mobile crane, limits are set fundamentally with respect to its dimensions and thus with respect to possible load moments and lifting heights of loads. In general, such a mobile crane cannot be higher than four meters, no wider than three meters and its length is limited in general to seven to eight axles. With today's modern road construction including traffic circles and other constrictions, it is advantageous not to construct the mobile crane with maximum possible dimensions, so that it is maneuverable and can be advanced in densely populated regions without problems. Limits that may not be exceeded are also given with respect to its overall weight with a maximum axle load of twelve tons. On the other hand, the operating needs of such a mobile crane increasingly involve greater loads and constantly higher lifts. Therefore, mobile cranes have been provided with separate booms, where such separate boom is transported separately, for example, on a semitrailer truck or a specially designed transport vehicle. Thus, such separate booms can be built with greater dimensions than booms mounted directly on the mobile crane.

A known mobile crane disclosed in DE-A1 31 39 596 includes a crane travel frame, a crane upper carrying chassis attached to a rotary connection, and a separate telescopic boom. During the mounting of the latter on the crane upper carrying chassis, the crane travel frame and a boom transporter must first be coupled together backwards. This arrangement results in spatially limited mountability of the boom, because the space requirements do not always allow two extremely long travel frames or vehicles to be placed in succession. By telescoping the separate boom, such boom is slid by way of a sliding runway, which can be swung upwardly, onto the crane upper carrying chassis. After automatic bolting, on the one hand, and releasing of a hoisting cylinder, on the one hand, the boom can be lifted up when the crane is supported. Then, a counterweight can be deposited by the crane itself by way of a motor of the travel frame. By swivelling the crane upper carrying chassis, the mobile crane thus is moved into the actual operating state. With this crane high carrying forces and very long boom lengths can be obtained. However, such crane has the drawback that its assembly, erection and mounting, as explained above, is very complicated and time intensive and, therefore, not economical. In addition, the boom has to be loaded on a specially designed transporter, and an auxiliary crane must be provided to position massive and heavy plates that support the crane. Thus, the result is high acquisition costs and as a consequence high operating costs of this known system. Another drawback with this known mobile crane is that it can function only with a hydraulic boom. This significantly limits the field of application of the mobile crane.

SUMMARY OF THE INVENTION

In contrast, the object of the present invention is to improve a mobile crane of the aforementioned type in such a manner that it is possible to achieve with it maximum carrying loads and maximum boom lengths in conjunction with simpler and faster mounting and assembly and/or that it allows universal application.

This object is achieved according to the invention by providing the boom that is pivoted to the upper carrying chassis in the form of a one-piece base section or members that is designed in such a manner that with it alone especially auxiliary crane operations such as erecting the mobile crane can be performed and that a free or operating end of such base section is provided with attachment devices for attaching a separate boom.

The mobile crane accordingly to the invention provides the substantial advantage that crane operations can be performed with the one-piece base section which is mounted stationarily on the upper carrying chassis, virtually without any assembly operation and without support by auxiliary cranes or similar crane operations, either with respect to lifting of small loads or for erection operations of the mobile crane such as loading ballast and naturally also for attaching the separate boom. On the other hand, maximum loads can be lifted to maximum heights or lowered with the fully equipped mobile crane, while the dimensions of the crane can be kept smaller than those of all prior art mobile cranes designed for maximum loads. If, however, the maximum dimensions specified by road law are used for a mobile crane according to the invention, then load moments and lifts can be achieved with the mobile crane that exceed by a significant amount the loads of those of the prior art, because absolute peak performance can be obtained when the base section and the separate boom exhibit maximum dimensions. In addition, the mobile crane according to the invention lends itself to universal application that has never been attained with existing cranes. This feature is demonstrated by the fact that it can be deployed absolutely economically both for smaller as well as for maximum loads without complicated assembly operations.

The one-piece base section has one end pivotally connected to the upper carrying chassis at a position spaced from the location of pivotal mounted of the upper carrying chassis to a lower chassis, such spacing being in a direction from said pivotal mounting opposite a free front end of said base section and by a substantial distance along the length of the lower chassis or crane travel frame. In addition, the free front end of the base section projects in every rotational position of the upper carrying chassis, with the base section pivoted to a horizontal position, beyond the crane travel frame. Thus, the prerequisite for the base section working independently is provided in an optimal manner. In addition, with such dimensioning of the base section, the separate boom can be mounted quite simply and rapidly.

For the aforementioned crane operations with the one-piece base section, the front or free end region of the base section includes at least one pivoted roller for a cable guide to receive a crane hook. Also, a jib or arm, which can be used for maximum lift, can be pivotally mounted on the front or free end of the base section. Such jib can be located in a position in which it forms an elongating extension of the base section and its tip can have at least one roller for a cable guide to receive the crane hook and thus to carry out crane operations.

Furthermore, the base section is pivotable with respect to the crane travel frame by a slightly negative angle, preferably up to 15°, relative to the horizontal plane. Thus, the separate boom brought forward, for example on a semitrailer truck, can be attached directly to the free or front end of the base section.

The base section or member advantageously is of a lattice construction, resulting on the one hand in a mobile crane that is lighter in weight than known cranes, and on the other hand a crane travel frame or lower chassis that can be built stronger. At least one hoisting cylinder swivelling the base section is held at one end thereof at the upper carrying chassis and at the other end thereof within the base section. Thus, the base section in turn can be swivelled at a slightly negative angle relative to the horizontal plane and assembly thereof to the separate boom can be made easier.

BRIEF DESCRIPTION OF THE DRAWINGS

Other objects, features, advantages and embodiments of the invention are explained in detail in the following with reference to the accompanying drawings, wherein.

DETAILED DESCRIPTION OF THE INVENTION

Figure 1:
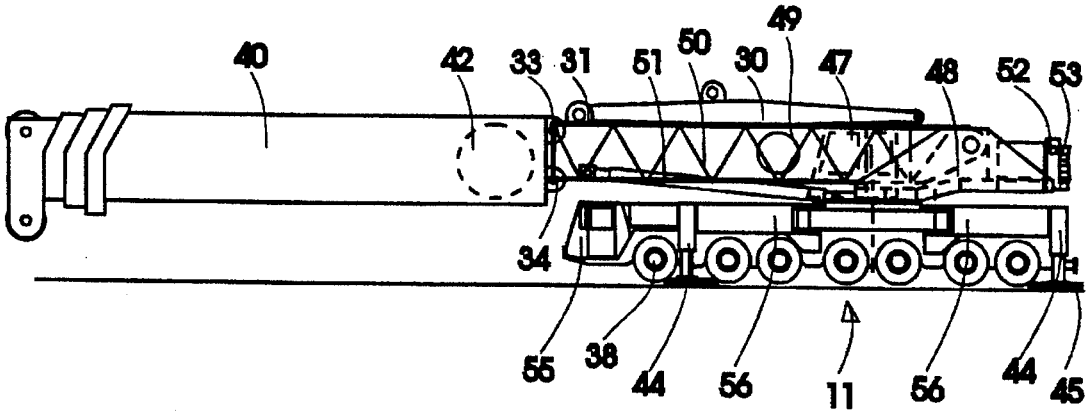
FIG. 1 is a diagrammatic side view of a mobile crane according to the invention with a separate telescopic boom mounted thereon.

In FIG. 1 a mobile crane is shown almost totally erected and is in a starting position. The mobile crane includes in essence a self-propelled travel frame or lower crane carrying chassis crane undercarriage 11, an upper load lifting and carrying chassis 48 that can be pivoted around a vertical axis relative to undercarriage 11, a cab 47 situated on upper carrying chassis 48 for operating the crane, a base section or member 50 that can be pivoted or swung around a horizontal axis on the upper carrying chassis 48, and a separate telescopic boom 40 attached to a free or forward operating end of base section 50. One or preferably two hoisting cylinders 51 acting in parallel are hinged at first ends to the upper carrying chassis 48 and at second ends to the base section 50, with which hoisting cylinder(s) base section 50 can be swivelled upwardly or downwardly about the horizontal axis relative to chassis 48. In the illustrated arrangement, a ballast carrier 52 serving as a counterweight, equipped with ballast plates 53 stacked thereon, is attached to a rear non-operating end of the upper carrying chassis 48. The undercarriage 11 has at the front thereof a driver's cab 55, seven wheel axles 38 and a so-called star brace or support 56, each of opposite sides of which has two outrigger supporting legs 44 which can be extended or retracted individually relative to the vertical axis of rotation of the upper carrying chassis 48. Supporting legs 44 are shown in an extended state, in which wheels of the crane are lifted from the ground and thus the crane is erected in a position for carrying out a crane operation. Undercarriage 11 includes known elements and is, therefore, not shown exactly in every detail and is not described further.

Compared to all known prior art mobile cranes, however, the mobile crane of the invention includes a novel base section 50, which is characterized by the following features. Above all, base section 50 is provided as an elongated integral member that is longitudinally structurally rigid and non-extendible and that is designed in such a manner that with it alone in particular auxiliary crane operations can be performed and that attachment devices 33 and 34 for attaching the separate boom 40 are provided at the free end of base section 50. Separate boom 40 is constructed with significantly larger dimensions than a prior art boom attached directly to the upper carrying chassis 48, where the overall height and width of the mobile crane may not be exceeded and also its total weight is limited. The result is a big plus for the mobile crane according to the invention, since absolute peak loads and lifts can be achieved with the separate telescopic boom 40, which is significantly larger than a boom placed directly on the chassis 48, together with the base section 50 provided with maximum dimensions. The base section 50 is made of a lattice construction, and thus the total weight of the mobile crane can be reduced further, and thereby the undercarriage 11 and the upper carrying chassis 48 can be built stronger. For the base section 50 to achieve maximum dimensions, it extends approximately over a substantial portion of the length of undercarriage 11, and in addition its attachment to the upper carrying chassis 48 is provided as close as possible to the end region of undercarriage 11. Furthermore, a main winch 42 is integrated into the separate telescopic boom 40, thus contributing to faster assembly of the crane. Pin-type locking systems distributed at four corners of the free end of base section 50 serve as attachment devices 33 and 34 for the telescopic boom 40. Such attachment devices are hydraulically operated and can be operated from the cab 47, and six or even more of such attachment devices could also be provided. Moreover, FIG. 1 shows how the undercarriage 11 is positioned with supporting legs 44 on base plates 45 placed on the ground. The supporting legs 44 can be extended horizontally and thus their length can be adjusted as a function of the terrain.

Figure 2:
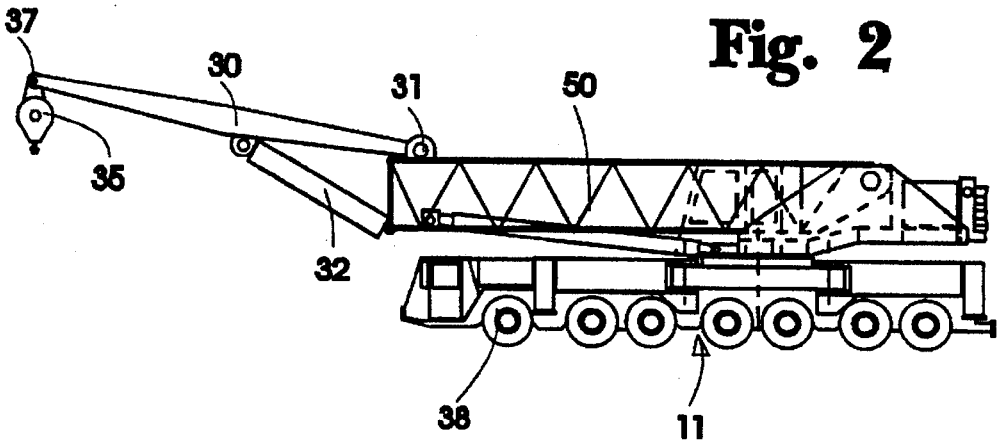
FIG. 2 is a diagrammatic side view of the mobile crane shown in FIG. 1, but without the separate boom and showing a crane operation carried out by a pivotable jib.

The mobile crane shown in FIG. 2 corresponds to that shown in FIG. 1, but the separate boom 40 is not mounted. A lifting device in the form of a jib or arm 30 is mounted adjacent the free end of the base section 50 so as to swivel in a vertical plane about an axle 31. Arm 30 facilitates conducting a crane operation with only the base section 50, i.e. without boom 40. Arm 30 is mounted firmly or detachably by means of an axle 31 and is positioned by a support element 32 approximately parallel to and as an elongated extension of the base section 50, thus providing additional maximum lift thereof. A cable, not shown in detail, is guided from a winch 49 in the base section 50 to a roller 37 at the top if arm 30 and held there by means of a crane hook 35. The advantage of this arrangement is that smaller loads can be handled and conveyed. This increases in principle the flexibility of the mobile crane of the invention, either for erecting the same or for conveying smaller loads.

The mobile crane is erected in such a manner that first the arm 30 is braced by means of the support element 32 mounted on the one-piece base section 50 in the position shown in FIG. 2, i.e. as an elongating extension of section 50. Then the cable guide and the crane hook 35 are moved into operation position. The arm 30 can be rotated into such position around the axle 31 by means of a hoisting cylinder on the base section 50 or by a suitable different type of drive. Subsequently, the base section 50 is swivelled upwardly and by means thereof ballast 52, 53 advanced into position on a separate truck is deposited onto the rear of the upper carrying chassis 48, wherein for this purpose the latter is rotated by 180° with respect to the position shown in FIG.

2. Subsequently, the base plates 45 are laid by the mobile crane itself at requisite positions, and then the star support 56 is installed by means of swivelling out and lowering the individual support legs 44 to support the mobile crane. Next, the separate boom 40 is connected to the base section 50. The telescopic boom 40 is moved into position, for example on a semitrailer truck, and then can be lifted either directly to the base section 50 or first by the latter into a defined mounting position. In any case, the mobile crane according to the invention can be assembled and made available for use very rapidly and thus extremely efficiently into the erected position necessary to function effectively.

The ballast, which can weigh up to 50 tons maximum, is loaded normally by the base section 50 itself into a predetermined position on the front of the undercarriage 11. However, for an undercarriage 11 with star support it is also conceivable that the ballast can be ballasted up onto the support legs 44 instead of onto the undercarriage 11, and then hung, as described above, on the rear end of the upper carrying chassis 48. In so doing, the ballast is deposited on two support legs 44 totally extended in an advantageous manner, but it could be deposited either on one of the two sides of the crane or on the rear two support legs.

Figure 3:
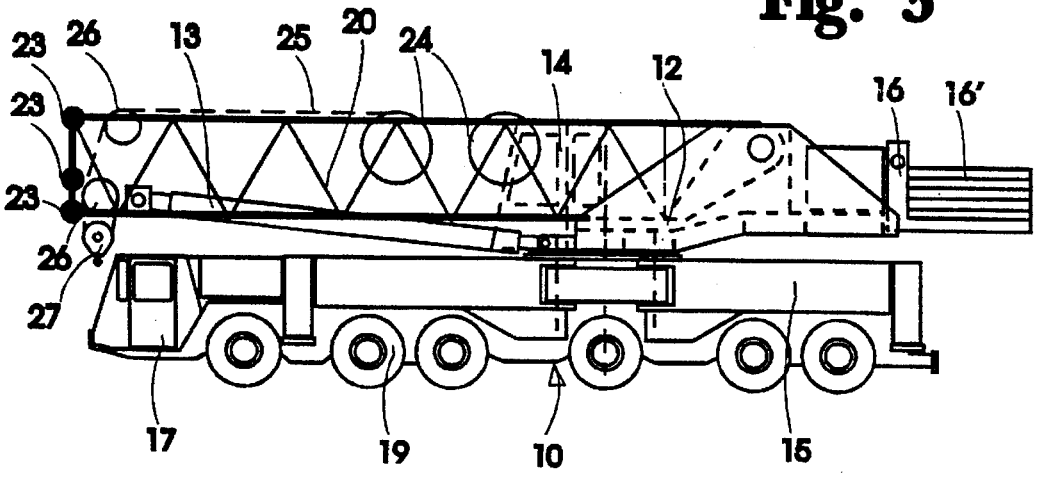
FIG. 3 is a diagrammatic side view of a modified mobile crane.

The mobile crane shown in FIG. 3 comprises an undercarriage 10, an upper carrying chassis 12 mounted on undercarriage so as to rotate relative thereto around a vertical axis, a cab 14 situated on upper carrying chassis 12 in order to operate the crane, a base section 20 which can be pivoted around a horizontal axis on the upper carrying chassis 12, and one or preferably two hoisting cylinders 13 with which base section 20 can be swivelled upwardly or downwardly. In this embodiment, a ballast carrier 16 serving as a counterweight and supporting stacked ballast plates 16' are hung on the rear of the upper carrying chassis 12. The undercarriage 10 has in the front thereof a driver's cab 17, six wheel axles 19, and a so-called star brace or support 15, each of opposite sides of which has two outrigger support legs that can be extended and retracted individually and are symmetrical to the axis of rotation of the upper carrying chassis 12. Such support legs are shown in the retracted state, in which they can be driven around the mobile crane. This described mobile crane also comprises well-known elements and is, therefore, not shown exactly in every detail and is not described further. In any case, lifting winches 24 are integrated into base section 20. A cable 25 is guided starting from such lifting winches by way of rollers 26 to a front bottom position of base section 20 and from it hangs a lifting device in the form of a crane hook 27 for lifting and lowering of loads. The base section 20 is dimensioned and mounted in such a manner on the upper carrying chassis 12 that its free or operating forward end projects in any rotary position, with base section 20 positioned horizontally, beyond the undercarriage 10, and thus it can receive, with the crane hook 27, loads located at any arbitrary point next to the undercarriage 10. In addition, base section 20 extends over a substantial portion of the entire length of the undercarriage 10 and can be rotated to end regions of the undercarriage. Thus, with the mobile crane according to this embodiment of the invention, smaller crane operations can be accomplished rapidly and expediently than otherwise was done with a mobile crane of smaller dimensions. Also, the mobile crane can erect or assemble itself completely as in the case of the mobile crane of FIG. 1 in an absolutely minimum amount of time, so that it can receive absolutely maximum loads and peak lift in a state with the separate boom attached. Moreover, three pairs of attachment devices 23, which allow attachment of separate booms of different dimensions, are provided at the free operating end of the base section 20 at different positions relative to the height thereof. These features combined result in the aforementioned unique universality and versatility of this mobile crane.

Figure 4:
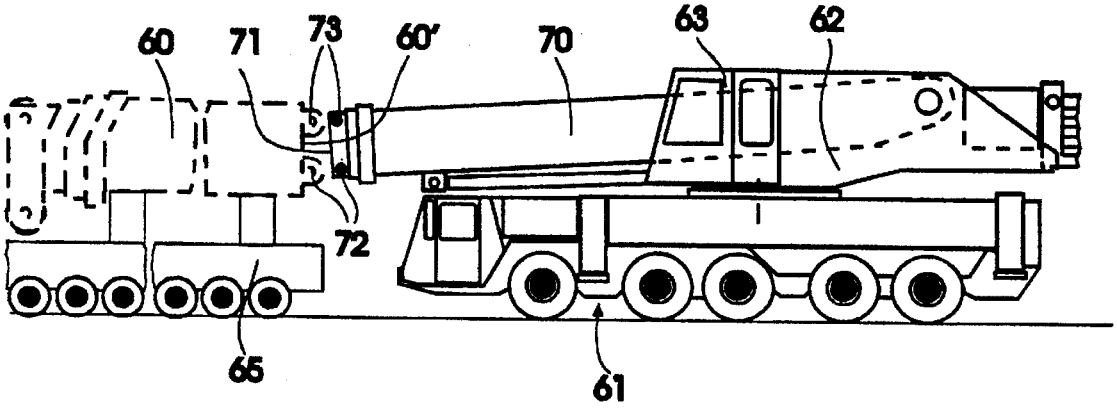
FIG. 4 is a diagrammatic side view of another variation of a basic mobile crane according to the invention.

The mobile crane according to FIG. 4 is constructed in principle just like those explained above in detail and therefore only different components thereof are described in detail in the following. This mobile crane includes a five-axle undercarriage 61, an upper carrying chassis 62 that can be rotated about a vertical axis relative to undercarriage 61, a cab 63, and a base section 70 of different type than described above. Base section 70 has a box-like construction and is shown to extend slightly downwardly forwardly at a negative angle to the horizontal or to the longitudinal dimension of undercarriage 61. In this swivel position of base section 70, a free or operating free end 71 thereof can be coupled without any problem to a rear face 60' of a separate telescopic boom 60 supplied on a semitrailer truck 65 and without there having to be any special aids or lifting structures on the semitrailer truck. This connection is achieved by first bolting an upper attachment device 73, then slightly swivelling and lifting the base section 70 resulting in alignment with a bottom attachment device 72, and then also fastening device 72 with bolts.

In the above described embodiments, the separate booms are shown exclusively as telescopic booms. However, such separate booms could be provided just as logically as lattice constructions of one or more parts or also as one-piece designs of closed construction. In this respect, the mobile crane according to the invention can include several different separate booms or also several base sections in the sense of a modular system, and depending on the application the one or other boom and respective base section can be used.

The mobile or self propelled crane according to the invention is also suitable primarily for the process specified above while assembling the separate boom 60 according to FIG. 4. At the same time, boom 60 is braced at one end thereof against a semitrailer truck and with its other end hinged by the attachment device 72 and/or 73 to the base section 70. Thus, they can be traversed at the job site, moved into the position required for a crane operation and erected.

I claim:

1. A self-propelled mobile crane comprising:

a self-propelled lower crane carrying chassis having at least five wheel axles;

an upper load lifting and carrying chassis mounted on said lower chassis to pivot about a vertical axis relative thereto;

a main boom mounted on said upper chassis to pivot about a horizontal axis relative thereto, said main boom comprising a single integral elongated member that is longitudinally structurally rigid and non-extendible, said member having at a forward free end terminating, when lowered, approximately above one end of said chassis and in attachment devices;

at least one hoisting cylinder mounted to pivot said main boom about said horizontal axis to selected positions including position whereat said main boom extends horizontally in a horizontal plane, said hoisting cylinder being mounted at a location lower than said main boom, such that when said hoisting cylinder is operated to pivot said main boom about said horizontal axis said hoisting cylinder is subjected to a compression stress by said main boom;

a separate boom supported on a separate conveyance vehicle, said separate boom being selectively connectable to said attachment devices at said free end of said main boom and removable from said separate conveyance vehicle, such that said separate boom can be rigidly joined to said free end of said main boom as a longitudinal extension thereof, whereby crane lifting and carrying operations can be performed from said separate boom, said separate boom being completely removable and separable from said main boom with the thus separated separate boom then being supported again on said separate conveyance vehicle for transport thereby separate from self-propelled movement of said lower chassis;

said main boom having pivotally mounted at said free end thereof at least one lifting device operable to enable crane lifting and carrying operations to be performed by said main boom, in any relative position of rotation of said upper chassis and said main boom about said vertical axis, when said separate boom is completely removed from and not joined to said free end of said main boom;

said mobile crane being movable by self-propelling of said lower chassis when said separate boom is completely removed from said main boom.

2. A mobile crane as claimed in claim 1, wherein said member has a lattice construction.

3. A mobile crane as claimed in claim 1, wherein said free end of said main boom extends beyond said lower chassis in all relative positions of rotation of said upper chassis about said vertical axis when said main boom is in said position extending horizontally in said horizontal plane.

4. A mobile crane as claimed in claim 1, wherein said lifting device at said free end comprises a roller defining a cable guide over which passes a cable, and a crane hook on said cable and movable relative to said roller.

5. A mobile crane as claimed in claim 1, wherein said lifting device at said free end comprises a jib pivoted to said main boom for movement relative thereto about a horizontal axis.

6. A mobile crane as claimed in claim 5, wherein said jib has a free end having a roller defining a cable guide and to receive a crane hook.

7. A mobile crane as claimed in claim 1, wherein said main boom is pivotable about said horizontal axis by said at least one hoisting cylinder to a said selected position such that said free end inclines downwardly therefrom at an acute angle to the horizontal.

8. A mobile crane as claimed in claim 7, wherein said angle is $\geqq 15°$.

9. A mobile crane as claimed in claim 1, wherein said cylinder has opposite ends hinged to said upper chassis and to said main boom, respectively.

10. A mobile crane as claimed in claim 1, comprising two parallel hoisting cylinders.

11. A mobile crane as claimed in claim 1, further comprising a main winch mounted on said separate boom, and an auxiliary winch mounted on said main boom.

12. A mobile crane as claimed in claim 1, comprising a plurality of separate booms selectively individually mountable on said free end of said main boom.

13. A mobile crane as claimed in claim 12, wherein said attachment devices are constructed to enable connection to said free end of selected of said plurality of separate booms having different sized mounting structure.

14. A mobile crane as claimed in claim 1, comprising plural main booms having connected thereto respective separate booms, said plural main booms being selectively individually mountable on said upper chassis for pivotal movement relative thereto about said horizontal axis.

15. A mobile crane as claimed in claim 1, wherein said horizontal axis is spaced from said vertical axis in a direction opposite said free end of said main boom, such spacing being such that said main boom has a length to extend, when in said horizontal position, over a substantial major portion of the length of said lower chassis.

* * * * *